US007146767B2

(12) United States Patent
Smerud

(10) Patent No.: US 7,146,767 B2
(45) **Date of Patent: *Dec. 12, 2006**

(54) STANDARDIZED ARCHED JAMB ASSEMBLY AND METHOD

(76) Inventor: Richard J. Smerud, 3667 Camino Marglesa, Escondido, CA (US) 92065

( * ) Notice: Subject to any disclaimer, the term of this patent is extended or adjusted under 35 U.S.C. 154(b) by 368 days.

This patent is subject to a terminal disclaimer.

(21) Appl. No.: 10/682,587

(22) Filed: Oct. 9, 2003

(65) Prior Publication Data

US 2004/0068941 A1 Apr. 15, 2004

Related U.S. Application Data

(63) Continuation-in-part of application No. 09/954,683, filed on Sep. 11, 2001, now Pat. No. 6,647,673.

(51) Int. Cl.
*E04B 1/32* (2006.01)

(52) U.S. Cl. ..... 52/88; 52/210

(58) Field of Classification Search ..... 52/86, 52/88, 204.1, 204.2, 210, 245, 329
See application file for complete search history.

(56) References Cited

U.S. PATENT DOCUMENTS 391,463 A * 10/1888 Ellis ..... 14/24
4,955,168 A * 9/1990 Barry ..... 52/210
5,245,802 A * 9/1993 Davis ..... 52/86
5,526,618 A * 6/1996 Thomas ..... 52/211
5,584,148 A * 12/1996 Barry et al. ..... 52/86
6,401,405 B1 * 6/2002 Hicks ..... 52/88

* cited by examiner

*Primary Examiner*—Naoko Slack
*Assistant Examiner*—Jessica Laux
(74) *Attorney, Agent, or Firm*—Gordon & Rees LLP

(57) ABSTRACT

An arched jamb assembly includes an arched jamb member and a pair of opposite upright jamb members with angled cuts made at opposite ends of the arched jamb member and upper end portions of the upright jamb members where the arched jamb member meets and interfaces with the upright jamb members to form the arched jamb assembly. The interfacing angled cuts are two-sided and have substantially the same standard angular configurations, irrespective of variations in the radii of curvature of upper arched jamb members used with upright jamb members to provide wall openings of different widths. An additional stop cut may be formed at opposite ends of the arched jamb member, for bearing against inner stop faces of the upright jamb members.

14 Claims, 3 Drawing Sheets

STANDARDIZED ARCHED JAMB ASSEMBLY AND METHOD

CROSS REFERENCES TO RELATED APPLICATIONS

This application is a Continuation In Part of application Ser. No. 09/954,683 filed Sep. 11, 2001 now U.S. Pat. No. 6,647,673.

BACKGROUND OF THE INVENTION

1. Field of the Invention

The present invention generally relates to an arched jamb for providing arched wall openings, such as doorways, windows and the like, and, more particularly, is concerned with a standardized arched jamb assembly and method.

2. Description of the Prior Art

Arched jambs provide arched wall openings, such as doorways, in homes. Arched jambs generally cost more than conventional rectangular jambs but they dramatically enhance the aesthetic appeal and thus the market value of homes.

Prior art arched jambs typically have an upper arched jamb member which defines the top of the arched wall opening and a pair of upright jamb members which define the opposite sides of the wall opening. The upright jamb members have upper end portions which support the upper arched jamb member at its opposite ends. For aesthetic reasons, the upper arched jamb member is typically positioned at a standard height above the floor no matter what the width of the wall opening is between the upright jamb members. Thus, as the width of the wall opening or distance between the upright jamb members changes, the arched jamb members are utilized that have varying radii of curvature. Heretofore, such variation of arched jamb member curvatures has been accommodated by varying the configurations of the features that support the opposite ends of the arched jamb member which, in turn, accounts for a part of the greater costs of construction of arched jambs over conventional rectangular jambs.

For example, in one prior art arched jamb A as shown in FIG. 1, recesses B are cut in the upper end portions C of the upright jamb members D to receive the opposite ends E of the arched jamb member F. Whenever the radius of curvature "r" of the arched jamb member F and the distance "d" between the upright jamb members D are changed, the angular configuration of the recesses B of the upright jamb members D has to be changed which adds to the overall costs of the arched jambs.

In another prior art arched jamb disclosed in U.S. Pat. No. 6,128,864 to Barry et al., an upper elliptical arched assembly is made of a center arched member and two opposite side members attached to the center arched member. Each of the side members are cut with a taper at both end portions thereof. The side members are cut along respective first and second cut lines that form the tapered end portions. The first cut line is angled along the top portion of the side member such that the top surface of the top end portion of the side member is substantially parallel to the bottom surface of the center arched member when these pieces are attached together. Also, the second cut line is angled along the bottom end portion of the side members such that the top surface of the bottom end portion of the side members is substantially parallel to an inner row of wall studs, or upright members, when attached thereto. So in this prior art arched assembly, three separate pieces with two different radii of curvature are attached to each other to form a single arched assembly. Each side member is configured to transition the radius of curvature of the center arched member into the radius of curvature of each side member which requires different cuts to accommodate different radii of curvature. Thus, the upper arched assembly of this prior art arched jamb would add still further costs rather than reduce costs of arched jambs compared to conventional rectangular jambs.

From the foregoing discussion, it is readily understood that neither of these two prior art arched jambs seem to provide an effective solution of the aforementioned problem. Consequently, a need exists for an innovation which will provides a simple and inexpensive solution to the problem found in prior art arched jamb of an arched wall opening without introducing any new problems in place thereof.

SUMMARY OF THE INVENTION

The present invention provides a standardized arched jamb assembly and construction apparatus and method designed to satisfy the aforementioned need. The arched jamb assembly of the present invention introduces standardization in the sense that cuts made on the opposite ends of an arched jamb member and in the upper end portions of upright jamb members, that form the interfaces there between in the arched jamb assembly, have the same angular configurations, and thus are made standard, irrespective of the curvature of the upper arched jamb member and the horizontal distance between the upright jamb members which is the same as the width of the wall opening defined by the standard arched jamb assembly. The construction apparatus and method of the present invention provide simple and inexpensive tools, techniques and structure for use in constructing the standardized arched jamb assembly.

Accordingly, the present invention is directed to a standardized arched jamb assembly which comprises: (a) an arched jamb member having a pair of opposite ends and first angled cuts made on the opposite ends, the arched jamb member also having a predetermined curvature and radius of curvature; and (b) a pair of opposite upright jamb members having upper end portions and second angled cuts made in the upper end portions which meet and interface with the first angled cuts (notched cuts) on the opposite ends of the arched jamb member so as to assemble the arched jamb member with the upright jamb members to form an arched jamb assembly for defining a wall opening, the first and second angled cuts of the arched jamb member and upright jamb members being comprised of two sides and having substantially identical standard configurations irrespective of variations in the radius of curvature of the upper arched jamb member provided to define wall openings of different widths between the upright jamb members.

The present invention also is directed an apparatus for constructing an arched jamb member for an arched jamb assembly. The apparatus comprises: (a) a fixture having opposite ends and adapted to stationarily hold an arched jamb member such that opposite ends of the arched jamb member (or at least one end) extend outwardly from the opposite ends of the fixture; and (b) cutting means for making an angled cut at each of the opposite ends of the arched jamb member such that an apex is formed by the angled cut that protrudes outwardly from the respective opposite end of the arched jamb member.

The present invention further is directed to a method for constructing an arched jamb assembly which comprises the steps of: (a) making an angled end cut at each of a pair of opposite ends of an arched jamb member such that an apex is formed by the angled cut, preferably a right angle, that protrudes outwardly from the respective one of the opposite ends of the arched jamb member; (b) making an angled notch cut in an inner corner of each of the upper end portions of a pair of upright jamb members such that the angular configurations of the angled end cuts and angled notch cuts are substantially the same; and (c) placing the arched jamb member on the upper end portions of the upright jamb members such that the angled end cuts of the arched jamb member meet and interface with the angled notch cuts of the upright jamb members so as to assemble the arched jamb member with the upright jamb members to form an arched jamb assembly for defining a wall opening.

The present invention further allows for the fabrication of a standardized angled cut for the protrusion of the arched jamb member and notch of the upright jamb members and the standardized location and structure of the notch on the upright jamb members thereby avoiding the custom fabrication of openings depending upon the opening width. Further, the application of these standardized notch and protrusions provides substantial standardization of fabrication techniques.

According to another aspect of the present invention, an arched jamb assembly with an integral stop is provided, which comprises an arched jamb member having opposite ends, an upper face and a lower face, the arched jamb member having a stop portion extending along its lower face between its opposite ends, the stop portion having opposite ends, a pair of opposite upright jamb members for installing on opposite sides of a wall opening with the arched jamb member extending between the upright jamb members to frame the opening, each upright jamb member having an upper end portion and an inner face, and an upright stop member extending along the inner face and having an upper end portion adjacent the upper end portion of the upright jamb member, the arched jamb member having first angled cuts on its opposite ends, each angled cut comprising a first cut extending from the upper face, a second cut extending inwardly from said first cut into the end of said stop portion, and a third cut extending downwardly from said first cut to a lower face of said stop portion, and each upright jamb member having second angled cuts in the upper end portions of said upright jamb member and stop member, the second angled cuts being comprised of two sides only, whereby the first cut at a respective end of said arched jamb member engages a first side of said second angled cut when the arched jamb member is engaged between said upright jamb members, the second cut engages a second side of said second angled cut, and the third cut engages an outer face of the upright stop member.

The two sides of the second angled cuts may be at right angles to one another, with the first cut being vertical and the second cut being generally horizontal when the upright jamb members are installed in a door opening. The second cut extends across part of the width of the upright jamb member and the entire width of the stop member, which may also be formed integrally with the upright jamb member. The first cut and third cut of the arched jamb member extend parallel to one another in a generally vertical direction, while the second cut extends transversely between the first and second cuts. The first and second sets of angled cuts will be easy to make.

In the prior art arched jamb assemblies with stop members, the stop members were typically formed separately from the arched jamb member and upright jamb member, and then attached to the respective arched and upright jamb members by nails or the like. The ends of the stop members were cut separately from the jamb members prior to attachment of the stop members to the jamb members. This makes the assembly more complex and adds expense. In the present invention, all that is necessary is to make two perpendicular cuts simultaneously in the upper ends of the upright jamb member and two perpendicular cuts at opposite ends of the arched jamb member, and to make an additional perpendicular cut simultaneously at each end of the stop portion. The addition of the stops to the arched jamb assembly will improve stability of the overall structure.

According to another aspect of the present invention, a method of making an arched jamb assembly is provided, which comprises the steps of:

making a first angled end cut at each of a pair of opposite ends of an arched jamb member, each first angled end cut having only three perpendicular sides formed in a single cutting step, the three perpendicular sides comprising a first, generally vertical side extending from an upper face of the arched jamb member, a second, generally horizontal side extending generally horizontally inwardly from the first side, and a third, generally vertical side extending from the second side;

making a second angled notch cut at an inner corner of an upper end of each of a pair of upright jamb members, the angled notch cut having only two perpendicular sides and the angular configuration of the angled notch cut being substantially the same as the angular configuration of the first and second sides of the first angled end cut;

placing the upright jamb members at opposite sides of a wall opening such that the second angled notch cuts face inwardly and towards one another;

placing the arched jamb member to extend between the upper ends of the upright jamb members with the first and second sides of the angled end cuts of the arched jamb member engaging and interfacing with the angled notch cuts of the upright jamb members and the third side of each angled end cut acting as a stop against an inner face of the respective upright jamb member.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
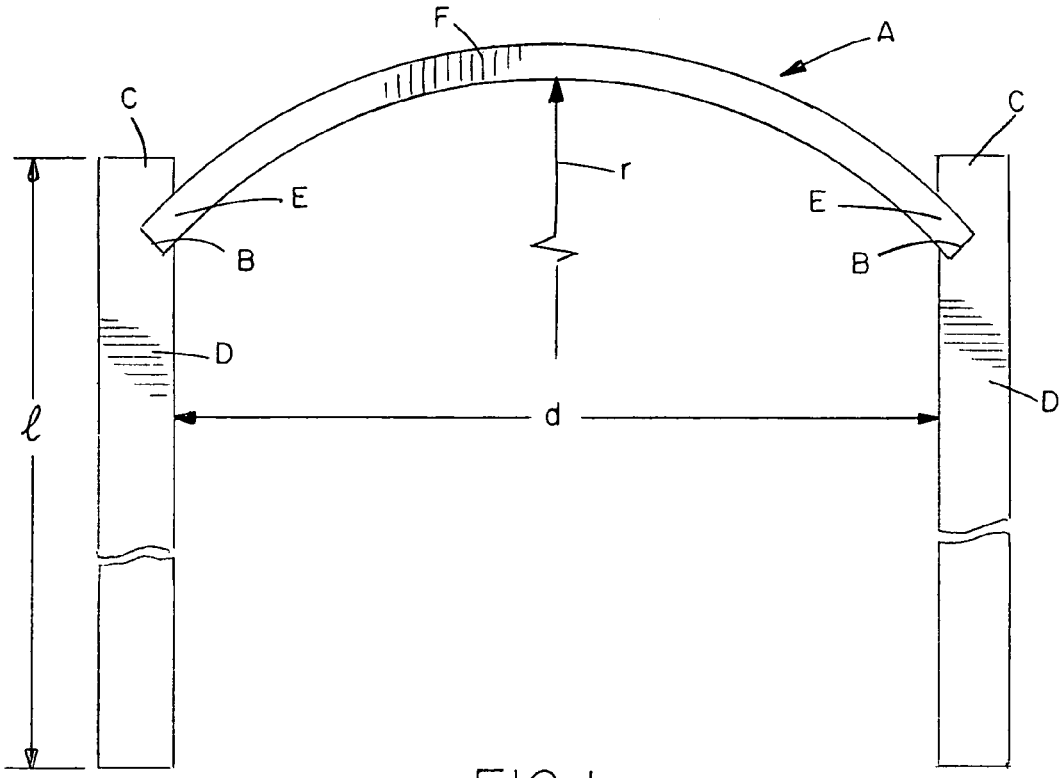
FIG. 1 PRIOR ART
FIG. 1 is a foreshortened front elevational view of a prior art arched jamb assembly.
Figure 2:
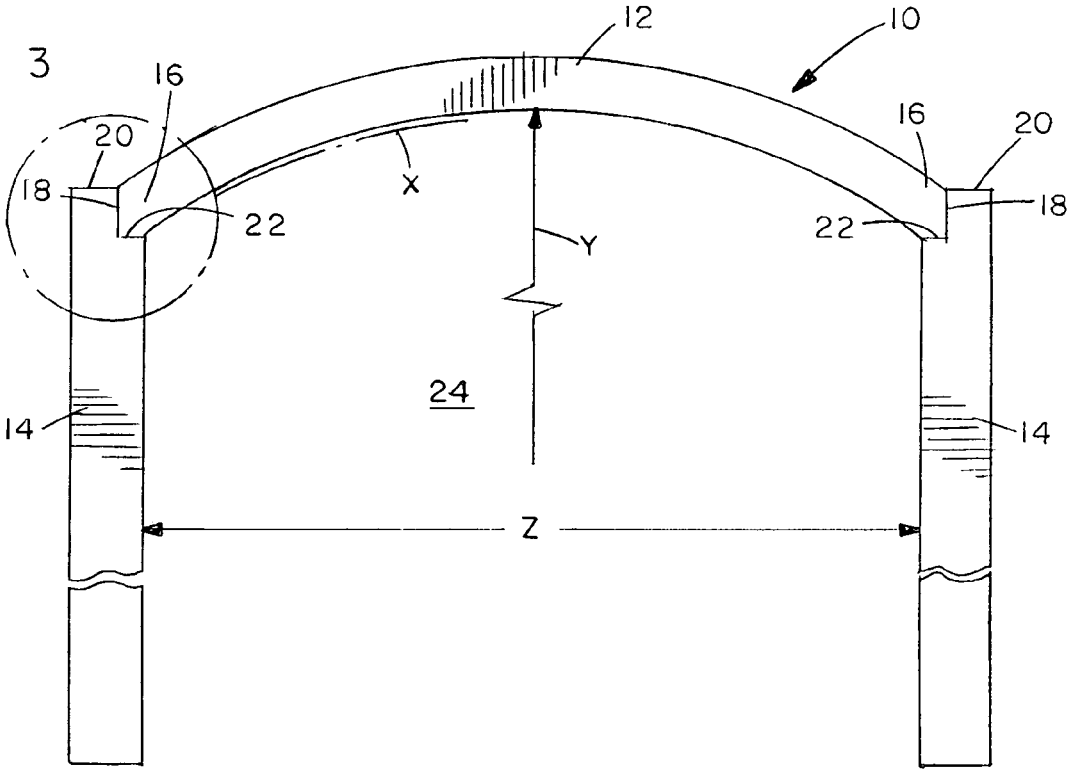
FIG. 2 is a foreshortened front elevational view of a standardized arched jamb assembly of the present invention having an upper arched jamb member and a pair of opposite lateral upright jamb members.

FIGS. 2 to 5 illustrate an arched jamb assembly according to a first embodiment of the present invention, generally designated 10. The assembly 10 basically includes an arched jamb member 12 and a pair of opposite upright jamb members 14 of wood, laminant, composite, plastic and/or combinations thereof.

The arched jamb member 12 of the assembly 10 has a pair of opposite ends 16, predetermined curvature "x" and radius of curvature "y", and a pair of first angled cuts 18 each made on one of the opposite ends 16 of the arched jamb member 12. Each upright jamb member 14 of the assembly 10 has an upper end portion 20 and a second angled cut (or notch) 22 made in the upper end portion 20. The first angled cuts 18 of the arched jamb member 12 respectively meet and interface with the second angled cuts 22 of the upright jamb members 14 so as to assemble the arched jamb member 12 with the upright jamb members 14 to form the arched jamb assembly 10 that defines a wall opening 24 below the upper arched jamb member 12 and between the lateral upright jamb members 14 of the assembly 10.

Referring to FIGS. 2 to 5, the angled cuts 18 of the arched jamb member 12 are illustrated in the exemplary embodiment of the assembly 10 as angled end cuts 18 being comprised of two sides 18A, 18B and an apex 18C formed by the intersection of the two sides 18A, 18B that points or protrudes outwardly from the respective opposite ends 16 of the arched jamb member 12. The angled cuts (or notches) 22 of the upright jamb members 14 are illustrated in the exemplary embodiment of the assembly 10 as angled notch cuts 22 made at inner corners 26, shown in dashed outline form, of the upper end portions 20 of the upright jamb members 14, which generally face toward one another, such that inner corners 26 are removed upon formation of the angled notch cuts 22. The angled notch cuts 22 also are comprised of two sides 22A, 22B and an apex 22C formed by the intersection of the two sides 22A, 2B that points or protrudes inwardly into the respective opposite end portions 20 of the upright jamb members 14. The angled end cuts 18 of the arched jamb member 12 and the angled notch cuts 22 of the upright jamb members 14 of the assembly 10 have substantially identical, and thus standardized, angular configurations, irrespective of variations in the curvature "x" and radius of curvature "y" of the upper arched jamb member 12 provided to define wall openings 24 of different widths or distances "z" between the upright jamb members 14.

More particularly, the two sides 18A, 18B of the angled end cuts 18 of the arched jamb member 18 and the two sides 22A, 22B of the angled notch cuts 22 of the upright jamb members 14 are preferably formed at substantially right angles such that, when the arched jamb member 12 and upright jamb members 14 are assembled into the arched jamb assembly 10, a first side 18A, 22A of each of the two-sided angled end cuts 18 and two-sided angled notch cuts 22 are horizontally-oriented, whereas a second side 18B, 22B of each of the two-sided angled end cuts 18 and two-sided angled notch cuts 22 is vertically-oriented. The width "w" of the horizontally-oriented first side 18A, 22A is "maintained constant" whereas the height "h" of the vertically-oriented second side 18B, 22B varies as the curvature "x" and radius of curvature "y" of the upper arched jamb member 12 varies in defining wall openings 24 of different widths and the same standard height. The height "h" of the angled notch cut 22B of the upper jamb member is preferably maintained constant but may vary as the curvature "x" and radius of curvature "y" of the upper arched jamb member 12 varies.

Figure 3:
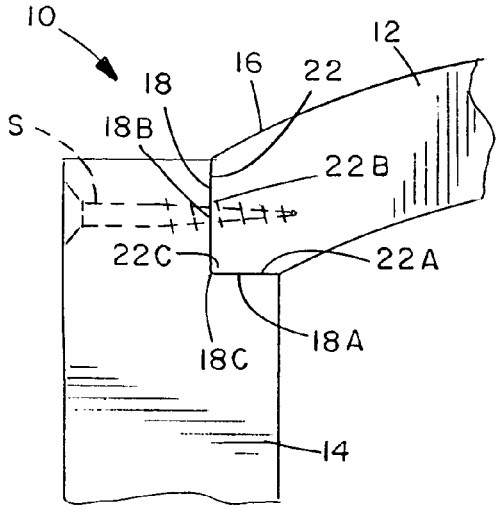
FIG. 3 is an enlarged detailed view of the portion of the arched jamb assembly encompassed by circle 3 of FIG. 2, also showing a fastener securing the upper arched jamb member to one of the upright jamb members of the assembly.
Figure 4:
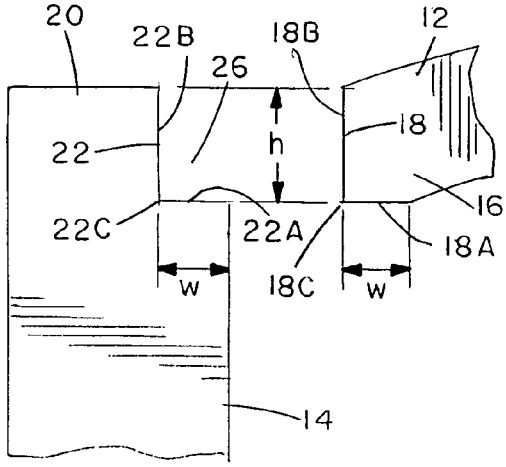
FIG. 4 is a view similar to FIG. 3 but showing the upper arched jamb member and the one upright jamb member in exploded relationship to one another.

The opposite ends 16 of the arched jamb member 12 and the upper end portions 20 of the upright jamb members 14 can be secured together in any suitable manner. One possible way to secure them together is by a conventional screw S, such as seen in FIG. 3. Examples of other suitable alternative ways are by nails, adhesive or pegs.

Figure 5:
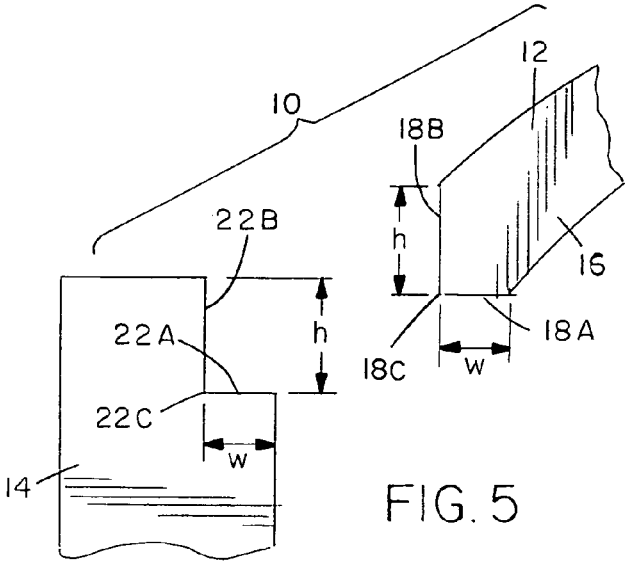
FIG. 5 is a view similar to that of FIG. 3 but showing the upper arched jamb member with a steeper curvature than the upper arched jamb member of FIG. 3 and depicting the greater height of vertically-oriented sides of the angled cuts of the arched jamb member from the steeper curvature of the arched jamb member with the standardized angled cut of the upright jamb member.
Figure 5A:
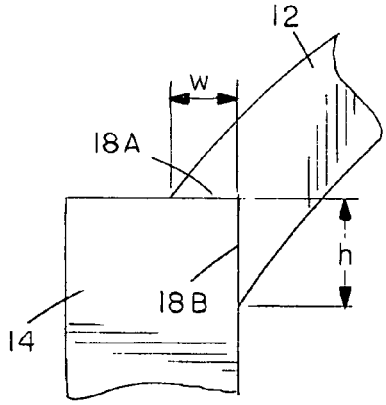
FIG. 5A is a view similar to that of FIG. 3 but showing a notch in the end of the upper arched jamb member and the corner of the upright jamb members forming a protrusion.

FIG. 5A illustrates an alternative arrangement where a notch is cut in the opposite ends of the arched jamb member 12, and this notch fib over an upper, inner corner of the respective upright jamb member 14. In this case, the width "w" of the horizontally-oriented first side 18A of the notch is made variable and the height "h" of the vertically-oriented second side 18B is constant as the curvature "x" and radius of curvature "y" of the upper arched member 12 varies. In addition, the width "w" could be made constant while the height "h" is allowed to vary. In this alternative, however, the notch is provided within the upper arched jamb member 12 and the protrusion is formed by the inside corner of the upright jamb members 14.

Figure 6:
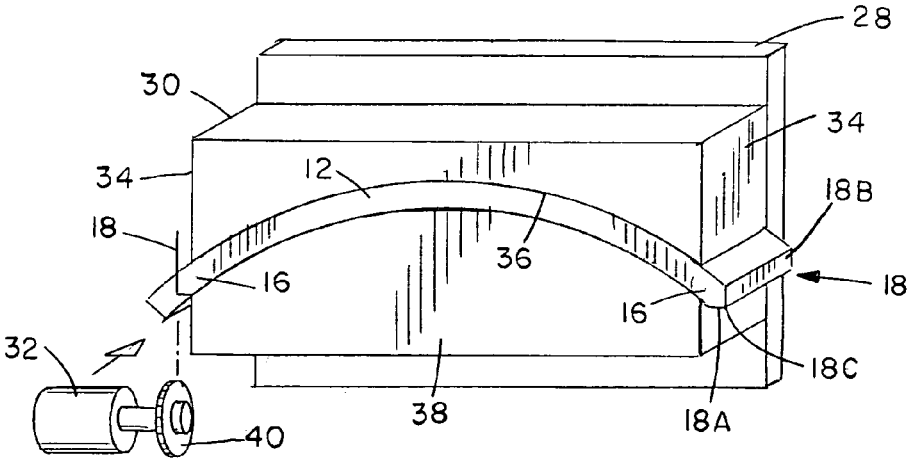
FIG. 6 is a perspective view of an exemplary embodiment of an apparatus for construction of the arched jamb member of the assembly.

Referring to FIG. 6, there is illustrated an apparatus 28 for constructing the arched jamb member 12. The apparatus 28 basically includes a jig or fixture 30 and cutting means 32. The fixture 30 of the apparatus 28 has opposite ends 34 and can have an arcuate shaped slot 36 formed therein being open at a front side 38 of the fixture 30 and extending between the opposite ends 34 thereof. In addition, or as alternatives, to the slot 36, devices such as clamps (not shown) and the like can be employed at the opposite ends 34 of the fixture 30 to hold the arched jamb member 12 adjacent to its opposite ends 16. The slot 36 has the same curvature as the arched jamb member 12 to receive and stationarily hold the arched jamb member 12 such that one or both ends of its opposite ends 16 extend outwardly from and beyond one or both of the opposite ends 34 of the fixture 30, respectively, as seen in FIG. 6.

The cutting means 32 of the apparatus 28 is adapted to make the angled end cut 18 at each of the opposite ends 16 of the arched jamb member 12 such that the apex 18C formed by the angled end cut 18 protrudes outwardly from the respective opposite end 16 of the arched jamb member 12. The cutting means 32 preferably is a cutting tool which per se is conventional, such as one utilizing a dado blade 40, and adapted to make a substantially right-angled cut. The cutting means 32 thus provides the two sides 18A, 18B of each of the angled end cuts 18 with the first side 18A being the horizontally-oriented side and the second side 18B being the vertically-oriented side of the arched jamb member 12 in the assembled arched jamb assembly 10. The cutting means 32 also provides a constant width to the horizontally-oriented first side 18A and a variable height to the vertically-oriented second side 18B which varies as a radius of curvature of the upper arched jamb member 12 varies to define wall openings 24 of different widths. The angled notch cut 22 can be made in the upper end portion 20 of each of the upright jamb member 14 in a conventional manner by using a conventional tool, such as a saw, router or the like, so as to provide an angled notch cut 22 (preferably right angled) identical in configuration to that of the angled end cut 18.

The cutting means 32 of the apparatus 28 may be linked or connected by any conventional means by mechanical linking, pneumatic controls or other conventional means such that the end cut 18 at each of the opposite ends are performed at substantially the same time. Alternatively, the cutting means 32 of the apparatus 28 for each end may be separate such that the end cuts are performed separately. The fixture 30 may be rotated from a first orientation to a second orientation such that only one cutting means 32 is required (not shown). The cutting means 32 may include separate horizontal and vertical cutters that are either linked or independent (not shown).

From the foregoing description of the exemplary embodiments of the arched jamb assembly 10 and construction apparatus 28, an exemplary method for constructing the arched jamb assembly 10 has the following steps. An angled end cut 18 is made at each of the opposite ends 16 of the arched jamb member 12 such that the apex 18C formed by the angled end cut 18 protrudes outwardly from the respective one of the opposite ends 16 of the arched jamb member 12. An angled notch cut 22 is made in the inner corner 26 of each of the upper end portions 20 of the upright jamb members 14 such that the width 'W' of the angled end cuts 18 and angled notch cuts 22 are substantially the same. The arched jamb member 12 at its opposite ends 16 is placed on the upper end portions 20 of the upright jamb members 14 such that the angled end cuts 18 of the arched jamb member 12 meet and interface with the angled notch cuts 22 of the upright jamb members 14 so as to assemble the arched jamb member 12 with the upright jamb members 14 to form the arched jamb assembly 10 for defining the wall opening 24.

Figure 7:
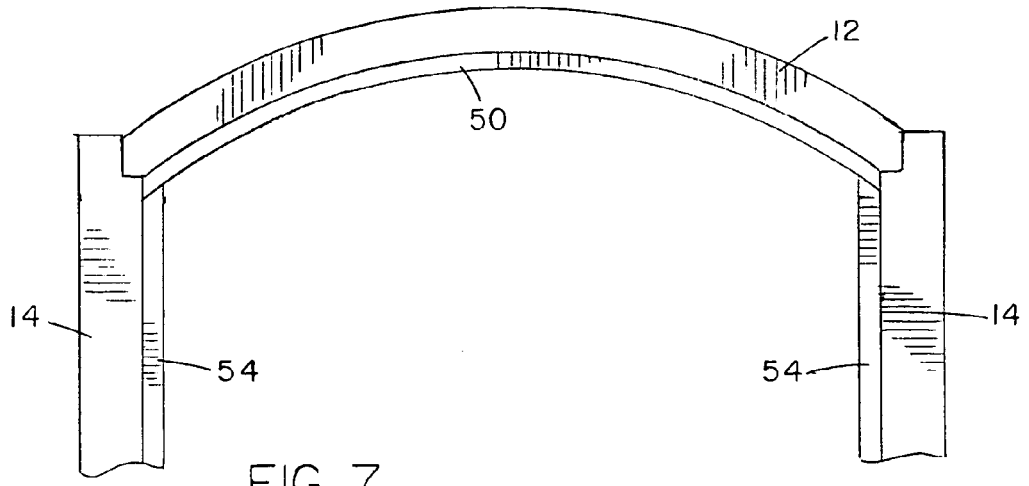
FIG. 7 is a front view of the arched jamb assembly of FIGS. 2 to 6, illustrating a known stop structure.
Figure 8:
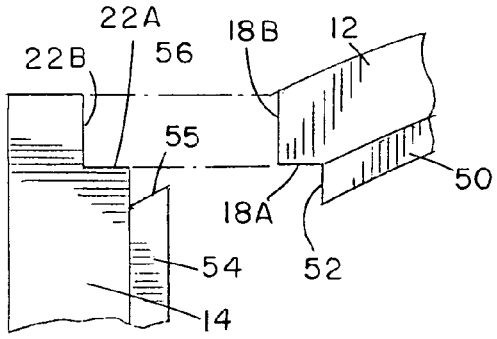
FIG. 8 is an enlargement of the upper left corner of FIG. 7, with the components separated.

Arched jamb assemblies are commonly used with additional stop members for more stability. FIGS. 7 and 8 illustrate the jamb assembly of FIGS. 2 to 5 with conventional stop members attached to the arched jamb member 12 and to each of the upright jamb members 14. The arched stop member 50 comprises a strip secured to the lower face of the arched jamb member 12 by nails, adhesive, or the like, and having opposite ends 52 which are cut at a predetermined angle. An upright stop member 54 is secured to the inner face of each upright jamb member 14 and has an upper end 55 cut at predetermined acute angle prior to securing to the upright jamb member by nails, adhesive, or the like, so that the angled cut end 55 is spaced below the cut face 22A. The parts are assembled as generally indicated in FIG. 8, with the two sides 18A and 18B of the angled notch cuts of the arched jamb member engaging against the angled indent notch cuts 22A and 22B at the upper end of the upright jamb member, while each end 52 of the arched stop member 50 fits into the indent formed between the upper end 55 of the upright stop member 54 and the adjacent outer surface portion 56 of the upright jamb member. It can be seen that the acute angled cut end 55 is arranged to fit against the angled undersurface of the arched stop member 50, while the cut end 52 of stop member 50 engages against the adjacent outer surface portion of upright jamb member 14.

The problem of using a standard stop assembly arrangement as in FIGS. 7 and 8 with the arched jamb assembly of FIGS. 2 to 5 is that the upright stop members 54 must be cut at their upper ends separately, prior to attachment to the upright jamb members, because the acute angle cut required would be difficult or impossible to make after these members are secured together. This makes the assembly procedure longer and more difficult. Also, the angle and depth of the cut 55 will vary dependent on the curvature of the lower face of stop member 50, which in turn varies with the width of the opening. However, use of a stop assembly does provide the advantage of improved stability and proper location of the arched jamb member between the upright jamb members.

Figure 9:
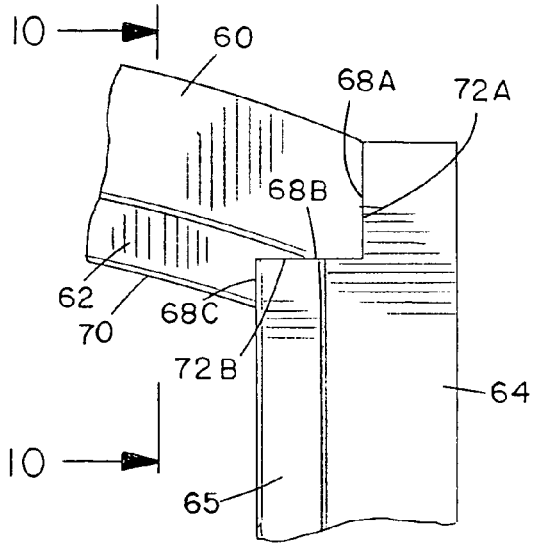
FIG. 9 is an enlarged front view of an alternative corner joint stop according to another embodiment of the invention.
Figure 10:
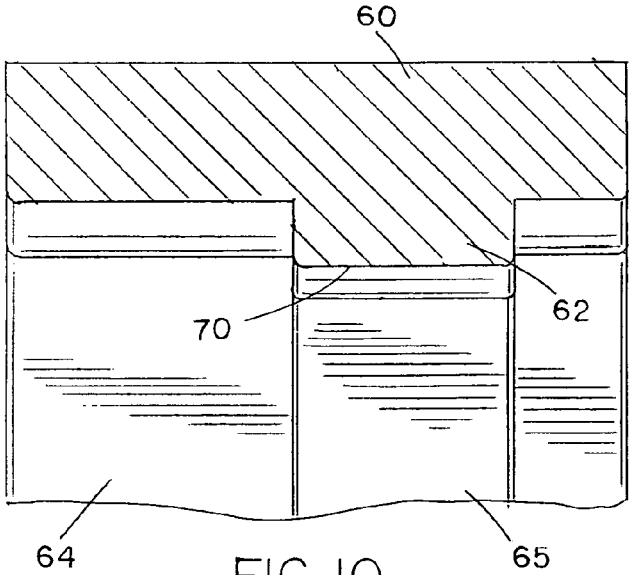
FIG. 10 is a sectional view taken on line 10-10 of FIG. 9.
Figure 11:
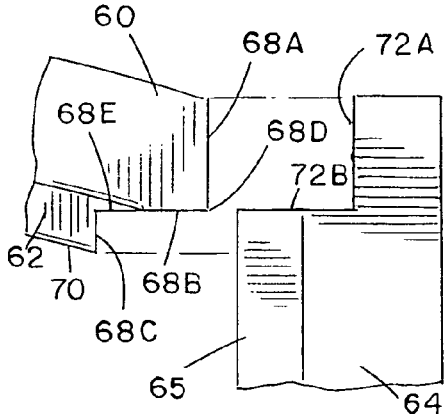
FIG. 11 is a view similar to FIG. 9, with the components separated.

FIGS. 9 to 11 illustrate an improved arched jamb assembly with a modified stop assembly, according to another embodiment of the invention. The assembly basically comprises an arched jamb member 60 with a built-in, integral arched stop portion 62, and a pair of upright jamb members 64 each with a built-in, integral stop member or portion 65 of width and position corresponding to that of arched stop portion 62. Although only part of the arched jamb member 60 and part of one of the upright jamb members 64 are illustrated in the drawings, it will be understood that the arched jamb member 60 will follow the general, arched elongate shape of jamb member 12 and will have an opposite, left hand end which is a mirror image of the right hand end 66 illustrated in FIGS. 9 and 11. It will also be understood that there will be two upright jamb members 64, a right hand and a left hand upright jamb member for opposite sides of the wall opening. These are equivalent to the upright jamb members 14 of the previous embodiment, apart from the added, integral stop portions 65 and different end cut arrangement. Although both the arched jamb member 60 and the upright jamb members 64 in the illustrated embodiment have an integrally formed stop portion, the stop portions may alternatively be formed separately and secured to the jamb members by bonding, screws, nails or the like. However, the integrally formed stop portions have the advantage of reducing the number of parts and simplifying manufacture and assembly. As in the previous embodiment, the parts of the jamb assembly may be made of wood, wood laminate or composite, plastic, and/or combinations thereof.

In the previous embodiment, which had no built-in stop members or portions, the arched jamb member had first angled cuts at its opposite ends, each having two perpendicular sides 18A and 18B, while the upright jamb members had indents at their upper ends for receiving the cut ends of the arched jamb member, each indent also having two perpendicular sides 22A and 22B. In this embodiment, opposite ends of the arched jamb member 60 and stop portion 62 have angled cuts each comprised of three sides 68A, 68B and 68C, with sides 68A and 68B forming a right angled outer corner 68D and sides 68B and 68C forming a right angled inner corner or indented corner 68E. The cut 68B extends inwardly from the end of the arched jamb member and partially into the stop portion 62, while the cut 68C extends from corner 68E to the lower face 70 of the stop portion 62. Cut side 68A is perpendicular to the adjacent cut side 68B, while cut side 68B is perpendicular to cut side 68C. All three cut sides can be formed simultaneously, for example in the manner illustrated in FIG. 6 for the previous embodiment.

The upright jamb members each have a second angled cut at their upper end, which has two perpendicular sides 72A and 72B, similar to the second angled cut of the previous embodiment, apart from the fact that horizontal cut 72B is an integral cut extending across part of the upright jamb member 64 and across the upper end of the stop portion 65. It can be seen that this is much simpler than the arrangement of FIG. 8, where a separate cut must be made at the upper end of stop member 54, and at a different angle from cut 22A. When the parts are assembled, the first two cut sides 68A, 68B at each end of the arched jamb member 60 engage in the indent formed by the cut sides 72A and 72B at the upper end of each upright jamb member 64, while the third cut side 68C engages against the outer face of the stop portion 65 of the respective upright jamb member, as illustrated in FIG. 9. The opposite ends of the arched jamb member 60 and the upper ends of the upright jamb members 64 can then be secured together in any suitable manner, by conventional screws or nails, or by adhesive, pegs or the like.

In this embodiment, the angled cuts are formed simultaneously in the jamb members and stop portions or members, and each set of angled cuts includes an integral cut across part of a jamb member and across the stop portion or member, i.e. cut 68B of the arched jamb member and cut 72B of the upright jamb member. This allows the cuts in each jamb member to be formed simultaneously in a one step operation, rather than requiring a separate cutting step for one or both stop members, which simplifies manufacture and assembly. Additionally, all the cuts, including the stop cut, will be at essentially the same angles regardless of the curvature of the arched jamb member. As in the embodiment of FIGS. 2 to 5, the angled end cuts of the arched jamb member and upright jamb members have standardized angular configurations, irrespective of the variations in the radius of curvature of the upper, arched jamb member 60 to provide different wall openings of different widths. This embodiment allows the stop cut 68C on the arched jamb member 60 to be cut simultaneously with the angled end cuts 68A and 68B, to form an angled end cut with three perpendicular sides, and also allows the separate stop cut of the upright jamb members to be eliminated, with the stop cut 68C of the arched jamb member instead bearing against the outer face of the stop portion 65. The cuts can all be formed after the arched jamb member and upright jamb members are made, either with integral stop portions as in the illustrated embodiment or with separate stop members attached to the jamb members, rather than having to form cuts prior to attachment of the stop members. This simplifies and speeds up the manufacture. The stop portions 65 of the upright jamb members may be formed with weather stripping grooves on one vertical side face at the junction between the side face and adjacent perpendicular face of the jamb member.

It is thought that the present invention and its advantages will be understood from the foregoing description and it will be apparent that various changes may be made thereto without departing from its spirit and scope of the invention or sacrificing all of its material advantages, the forms hereinbefore described being merely exemplary embodiments thereof.

I claim:

1. A standardized arched jamb assembly, comprising:

(a) an arched jamb member having a pair of opposite ends and first angled cuts made on said opposite ends, said arched jamb member also having a predetermined curvature and radius of curvature; and (b) a pair of opposite upright jamb members having upper end portions and second angled cuts made at said upper end portions which meet and interface with said first angled cuts on said opposite ends of said arched jamb member so as to assemble said arched jamb member with said upright jamb members to form an arched jamb assembly for defining a wall opening, said upright jamb members having inner faces, said first and second angled cuts of said arched jamb member and upright jamb members being comprised of two sides and having substantially identical standard angular configurations irrespective of variations in the radius of curvature of said arched jamb member provided to define wall openings of different widths between said upright jamb members;

wherein each end of the arched jamb member having a further angled stop cut extending perpendicular to one side of said first angled cuts for bearing against the inner face of the respective upright jamb member when said first angled cuts are interfaced with said second angled cuts.

2. A standardized arched jamb assembly for framing a wall opening, comprising:

(a) an arched jamb member having a pair of opposite ends and first angled cuts made on said opposite ends, said arched jamb member also having opposite front and rear faces facing in opposite directions from a wall opening when installed in said opening, a curved upper face and a curved lower face of predetermined curvature and radius of curvature, the arched jamb member being of predetermined width between said front and rear faces; and (b) a pair of opposite upright jamb members for installing on opposite sides of the wall opening, the upright jamb members each having an inner face facing the inner face of the other upright jamb member, and opposite front and rear faces, each upright jamb member being of predetermined width between said front and rear faces substantially matching the width of the arched jamb member, each upright jamb member having an upper end portion and second angled cuts made at said upper end portions which meet and interface with said first angled cuts on said opposite ends of said arched jamb member so as to assemble said arched jamb member with said upright jamb members to form an arched jamb assembly for framing a wall opening, such that the opposite front and rear faces of said arched jamb member are substantially flush with the opposite front and rear faces of said upright jamb members;

wherein said first angled cuts of said arched jamb member for interfacing with said second angled cuts of said upright jamb members and said second angled cuts of said upright jamb members each being comprised of two sides and having substantially identical standard angular configurations irrespective of variations in the radius of curvature of said arched jamb member provided to define wall openings of different widths between said upright jamb members; and wherein said two sides of said first and second angled cuts of said arched and upright jamb members are formed at substantially right angles.

3. A standardized arched jamb assembly for framing a wall opening, comprising:

(a) an arched jamb member having a pair of opposite ends and first angled cuts made on said opposite ends, said arched jamb member also having opposite front and rear faces facing in opposite directions from a wall opening when installed in said opening, a curved upper face and a curved lower face of predetermined curvature and radius of curvature, the arched jamb member being of predetermined width between said front and rear faces; and (b) a pair of opposite upright jamb members for installing on opposite sides of the wall opening, the upright jamb members each having an inner face facing the inner face of the other upright jamb member, and opposite front and rear faces, each upright jamb member being of predetermined width between said front and rear faces substantially matching the width of the arched jamb member, each upright jamb member having an upper end portion and second angled cuts made at said upper end portions which meet and interface with said first angled cuts on said opposite ends of said arched jamb member so as to assemble said arched iamb member with said upright iamb members to form an arched jamb assembly for framing a wall opening, such that the opposite front and rear faces of said arched jamb member are substantially flush with the opposite front and rear faces of said upright jamb members;

wherein said first angled cuts of said arched jamb member for interfacing with said second angled cuts of said upright jamb members and said second angled cuts of said upright jamb members each being comprised of two sides and having substantially identical standard angular configurations irrespective of variations in the radius of curvature of said arched jamb member provided to define wall openings of different widths between said upright iamb members; and wherein each of said angled cuts has two sides, a first side of said first and second angled cuts is horizontally-oriented and a second side of said first and second angled cuts is vertically-oriented.

4. The assembly of claim 3 wherein the width of said horizontally-oriented first side is constant and whereas the height of said vertically-oriented second side of said arched jamb member varies as said radius of curvature of said upper arched jamb member varies in defining wall openings of different widths.

5. A standardized arched jamb assembly for framing a wall opening, comprising:

(a) an arched jamb member having a pair of opposite ends and first angled cuts made on said opposite ends, said arched iamb member also having opposite front and rear faces facing in opposite directions from a wall opening when installed in said opening, a curved upper face and a curved lower face of predetermined curvature and radius of curvature, the arched jamb member being of predetermined width between said front and rear faces; and (b) a pair of opposite upright jamb members for installing on opposite sides of the wall opening, the upright jamb members each having an inner face facing the inner face of the other upright jamb member, and opposite front and rear faces, each upright iamb member being of predetermined width between said front and rear faces substantially matching the width of the arched jamb member, each upright jamb member having an upper end portion and second angled cuts made at said upper end portions which meet and interface with said first angled cuts on said opposite ends of said arched jamb member so as to assemble said arched jamb member with said upright jamb members to form an arched jamb assembly for framing a wall opening, such that the opposite front and rear faces of said arched jamb member are substantially flush with the opposite front and rear faces of said upright jamb members;

wherein said first angled cuts of said arched jamb member for interfacing with said second angled cuts of said upright jamb members and said second angled cuts of said upright jamb members each being comprised of two sides and having substantially identical standard angular configurations irrespective of variations in the radius of curvature of said arched jamb member provided to define wall openings of different widths between said upright jamb members; and wherein said two sides of said first angled cuts of said arched jamb member form a notch.

6. A standardized arched jamb assembly for framing a wall opening, comprising:

(a) an arched jamb member having a pair of opposite ends and first angled cuts made on said opposite ends, said arched jamb member also having opposite front and rear faces facing in opposite directions from a wall opening when installed in said opening, a curved upper face and a curved lower face of predetermined curvature and radius of curvature, the arched jamb member being of predetermined width between said front and rear faces; and (b) a pair of opposite upright jamb members for installing on opposite sides of the wall opening, the upright jamb members each having an inner face facing the inner face of the other upright jamb member, and opposite front and rear faces, each upright jamb member being of predetermined width between said front and rear faces substantially matching the width of the arched jamb member, each upright jamb member having an upper end portion and second angled cuts made at said upper end portions which meet and interface with said first angled cuts on said opposite ends of said arched jamb member so as to assemble said arched jamb member with said upright iamb members to form an arched jamb assembly for framing a wall opening, such that the opposite front and rear faces of said arched jamb member are substantially flush with the opposite front and rear faces of said upright jamb members;

wherein said first angled cuts of said arched jamb member for interfacing with said second angled cuts of said upright jamb members and said second angled cuts of said upright jamb members each being comprised of two sides and having substantially identical standard angular configurations irrespective of variations in the radius of curvature of said arched jamb member provided to define wall openings of different widths between said upright jamb members; and wherein said two sides of said second angled cuts of said upright jamb members form a protrusion which fits into said notch.

7. A standardized arched jamb assembly for framing a wall opening, comprising:

(a) an arched jamb member having a pair of opposite ends and first angled cuts made on said opposite ends, said arched jamb member also having opposite front and rear faces facing in opposite directions from a wall opening when installed in said opening, a curved upper face and a curved lower face of predetermined curvature and radius of curvature, the arched jamb member being of predetermined width between said front and rear faces; and (b) a pair of opposite upright jamb members for installing on opposite sides of the wall opening, the upright jamb members having an inner face, opposite front and rear faces and being of predetermined width between said front and rear faces substantially matching the width of the arched jamb member, each upright jamb member having an upper end portion and second angled cuts made at said upper end portions which meet and interface with said first angled cuts on said opposite ends of said arched jamb member so as to assemble said arched jamb member with said upright jamb members to form an arched jamb assembly for framing a wall opening, such that the opposite front and rear faces of said arched jamb member are substantially flush with the opposite front and rear faces of said upright jamb members;

wherein said first angled cuts of said arched jamb member for interfacing with said second angled cuts of said upright jamb members and said second angled cuts of said upright jamb members each being comprised of two sides and having substantially identical standard angular configurations irrespective of variations in the radius of curvature of said arched jamb member provided to define wall openings of different widths between said upright jamb members; and wherein each end of the arched jamb member has a further angled stop cut extending perpendicular to one side of said first angled cuts for bearing against the inner face of said upright jamb member when said first angled cuts are interfaced with said second angled cuts.

8. The assembly as claimed in claim 7, wherein said arched jamb member has an arched stop portion of reduced width extending along its lower face up to the opposite ends of said arched jamb member, said stop portion having opposite ends and said stop cuts being formed in the ends of said stop portions only.

9. The assembly as claimed in claim 8, wherein each upright jamb member has an upright stop portion on its inner face extending to the upper end portion of the jamb member and having an upper end and an outer face, the upright stop portion having an inner face and being of reduced width and positioned such that said stop cut on said arched stop portion bears against the inner face of said upright stop portion.

10. The assembly as claimed in claim 9, wherein each stop portion is formed integrally with the respective jamb member.

11. The assembly as claimed in claim 9, wherein each stop portion comprises a separate stop member attached to the respective jamb member.

12. The assembly as claimed in claim 8, wherein said first angled end cut has a first side and a second side perpendicular to said first side, said stop cut extending perpendicular to said second side.

13. The assembly as claimed in claim 12, wherein said two sides of said second angled cuts at the upper ends of said upright jamb members form a right angled notch having a first generally vertical side and a second generally horizontal side, the two sides of said first angled cut of said arched jamb member forming a protrusion which fits into said notch.

14. The assembly as claimed in claim 13, wherein each upright jamb member has an upright stop portion on its inner face extending to the upper end portion of the jamb member and having an upper end and an outer face, the second generally horizontal side of said right angled notch extending across the upper end of the stop portion to the outer face of the stop portion, the upright stop portion being of reduced width and positioned such that said stop cut on said arched stop portion bears against the outer face of said upright stop portion.

* * * * *